US008896221B2

(12) United States Patent
Esaki et al.

(10) Patent No.: US 8,896,221 B2
(45) Date of Patent: Nov. 25, 2014

(54) LIGHTING DEVICE FOR SEMICONDUCTOR LIGHT EMITTING ELEMENT AND ILLUMINATION APPARATUS INCLUDING SAME

(75) Inventors: Sana Esaki, Osaka (JP); Akinori Hiramatu, Nara (JP)

(73) Assignee: Panasonic Corporation, Osaka (JP)

( * ) Notice: Subject to any disclaimer, the term of this patent is extended or adjusted under 35 U.S.C. 154(b) by 167 days.

(21) Appl. No.: 13/433,406

(22) Filed: Mar. 29, 2012

(65) Prior Publication Data

US 2012/0249003 A1 Oct. 4, 2012

(30) Foreign Application Priority Data

Apr. 4, 2011 (JP) ..... 2011-083185

(51) Int. Cl.
*H05B 37/02* (2006.01)
*H05B 33/08* (2006.01)

(52) U.S. Cl.
CPC ..... *H05B 33/086* (2013.01)
USPC ..... 315/201; 315/186; 315/224; 315/291; 315/308

(58) Field of Classification Search
USPC ..... 315/186, 201, 209 R, 224, 226, 291, 315/307, 308
See application file for complete search history.

(56) References Cited

U.S. PATENT DOCUMENTS

| | | | | |
|---|---|---|---|---|
| 5,434,479 | A * | 7/1995 | Ohnishi et al. | 315/209 R |
| 2003/0043611 | A1* | 3/2003 | Bockle et al. | 363/131 |
| 2009/0021175 | A1* | 1/2009 | Wendt et al. | 315/200 R |
| 2009/0295300 | A1* | 12/2009 | King | 315/209 R |

FOREIGN PATENT DOCUMENTS

| | | | |
|---|---|---|---|
| CN | 1087463 | A | 6/1994 |
| CN | 101395791 | A | 3/2009 |
| CN | 201374865 | Y | 12/2009 |
| CN | 101668372 | | 3/2010 |
| JP | 2975029 | | 9/1999 |
| JP | 2001-351789 | | 12/2001 |

OTHER PUBLICATIONS

Chinese Office Action dated Jan. 3, 2014, issued in corresponding Chinese Application No. 20121008454.X and the English translation thereof.

* cited by examiner

*Primary Examiner* — Douglas W Owens
*Assistant Examiner* — Thai Pham
(74) *Attorney, Agent, or Firm* — Bacon & Thomas, PLLC

(57) ABSTRACT

A lighting device for a semiconductor light emitting element includes a series circuit of two switching elements which are alternately turned on, the series circuit being connected to a direct current (DC) input power source and a reactance circuit connected between a connection node of the two switching elements and one end of the DC input power source through a capacitor, an output of the reactance circuit being supplied to the semiconductor light emitting element through a rectifier circuit. A dimming operation of the semiconductor light emitting element is performed by varying a ratio of ON periods of the two switching elements.

14 Claims, 5 Drawing Sheets

LIGHTING DEVICE FOR SEMICONDUCTOR LIGHT EMITTING ELEMENT AND ILLUMINATION APPARATUS INCLUDING SAME

FIELD OF THE INVENTION

The present invention relates to a lighting device for a semiconductor light emitting element such as a light emitting diode (LED) and an illumination apparatus including same.

BACKGROUND OF THE INVENTION

Japanese Patent Application Publication No. 2001-351789 (FIG. 1) (hereinafter referred to as JP2001-351789) discloses a technique of dimming an LED load by connecting the LED load to an output of a half-bridge inverter circuit via an LC series resonant circuit and varying a switching frequency.

Japanese Patent No. 2,975,029 (FIG. 5) discloses a technique of dimming a discharge lamp load by connecting a hot cathode type discharge lamp load to an output of a half-bridge inverter circuit via an LC series resonant circuit and setting ON periods of two switching elements of the inverter circuit to be unequal during dimming. Further, there has been proposed a technique of supplying a preheating current while avoiding cold cathode discharge by setting the ON periods of the two switching elements of the inverter circuit to be substantially equal during preheating and setting a switching frequency to be sufficiently higher than a resonant frequency to reduce a resonant voltage applied to the load.

In accordance with the technique of JP2001-351789, the dimming operation of the LED load is performed by varying the switching frequency. Thus, in order to widen a dimming range, it is necessary to expand a variation range of the switching frequency, and there is a problem in that a high frequency side switching loss increases, or it is difficult to design a filter circuit for removing a switching noise. Further, the LED load has diode type load characteristics in which the load current hardly flows therethrough when a voltage across the LED load is equal to or less than a predetermined load voltage. Accordingly, in case of increasing the switching frequency, the resonant voltage applied to the load is reduced, and there is problem in that it is impossible to obtain a voltage required for turning on the LED load.

In JP2001-351789, there has also been proposed the technique of expanding the dimming range by intermittently pausing a high frequency switching operation at a low frequency (see Paragraph [0099] and FIG. 15 in JP2001-351789). However, in such case, there is a problem of an increase in flicker.

SUMMARY OF THE INVENTION

In view of the above, the present invention provides a lighting device for a semiconductor light emitting element, capable of realizing a dimming operation in a wide range while limiting a range of a switching frequency.

In accordance with an embodiment of the present invention, there is provided a lighting device for a semiconductor light emitting element, including: a series circuit of two switching elements which are alternately turned on, the series circuit being connected to a direct current (DC) input power source; and a reactance circuit connected between a connection node of the two switching elements and one end of the DC input power source through a capacitor, an output of the reactance circuit being supplied to the semiconductor light emitting element through a rectifier circuit. A dimming operation of the semiconductor light emitting element is performed by varying a ratio of ON periods of the two switching elements.

In accordance with another embodiment of the present invention, there is provided a lighting device for a semiconductor light emitting element, including: a series circuit of two switching elements which are alternately turned on, the series circuit being connected to a direct current (DC) input power source; and a reactance circuit connected between a connection node of the switching elements and one end of the DC input power source through a capacitor, an output of the reactance circuit being supplied to the semiconductor light emitting element through a rectifier circuit. A dimming operation of the semiconductor light emitting element is performed by varying a switching frequency and a ratio of ON periods of the two switching elements.

Further, the reactance circuit may include a series connection of a current-limiting choke and an additional capacitor, and the rectifier circuit may be connected to the additional capacitor.

Further, each of the switching elements may be connected in parallel to an anti-parallel diode, and the switching frequency of the switching elements may be set to be higher than a series resonant frequency of the current-limiting choke and the additional capacitor.

Further, the lighting device described above may further include a capacitor which is connected in parallel to the semiconductor light emitting element provided on an output side of the rectifier circuit.

Further, the ON period of one of the switching elements at a low potential side of the DC input power source may be controlled to be longer than the ON period of the other one of the switching elements at a high potential side of the DC input power source, and the lighting device described above may further include a bootstrap diode through which a charging current flows to a power capacitor of a drive circuit of said the other one of the switching elements from a power capacitor of a drive circuit of said one of the switching elements when said one of the switching elements is turned on.

Further, the rectifier circuit may include two half-wave rectifier circuits of reverse polarity, which are respectively connected to semiconductor light emitting elements having different color temperatures, and a color temperature of mixed light may be changed by controlling the ratio of the ON periods of the two switching elements, and luminance of the mixed light is changed by controlling the switching frequency of the two switching elements.

In accordance with still another embodiment of the present invention, there is provided an illumination apparatus including the lighting device for the semiconductor light emitting element described above.

In accordance with the present invention, a dimming operation of the semiconductor light emitting element is performed by varying a ratio of the ON periods of two switching elements that are alternately turned on. Thus, there is an effect of realizing the dimming operation in a wide range while limiting a range of the switching frequency.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings, which form a part hereof.

(First Embodiment)

Figure 1:
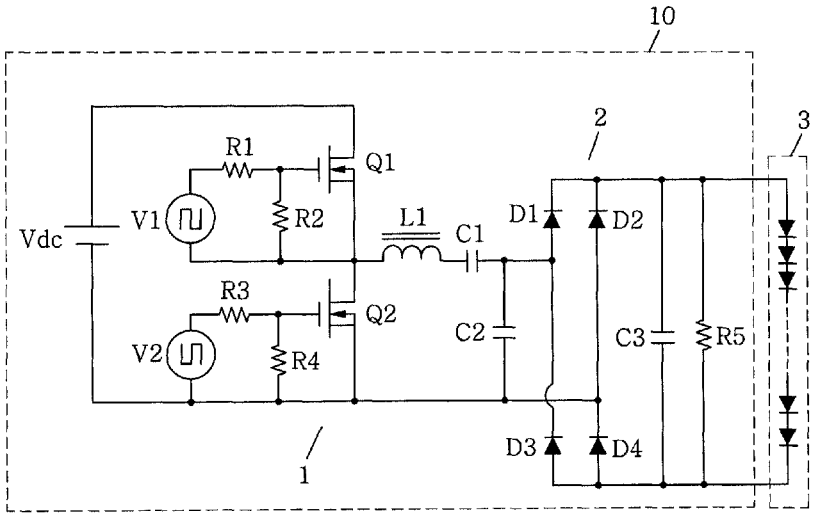
FIG. 1 is a circuit diagram of a lighting device for a semiconductor light emitting element in accordance with a first embodiment of the present invention.

FIG. 1 is a circuit diagram of a lighting device for a semiconductor light emitting element in accordance with in accordance with a first embodiment of the present invention.

The lighting device 10 in this embodiment includes a direct current (DC) input power source Vdc, signal sources V1 and V2, resistors R1 to R5, capacitors C1 to C3, an inductor L1, an inverter circuit 1 and a rectifier circuit 2.

The direct current (DC) input power source Vdc supplies a substantially constant DC voltage of, e.g., about 420 V, which is converted from an alternating current (AC) voltage of a commercial AC power source via a filter circuit, a full-wave rectifier circuit and a step-up chopper circuit.

The DC input power source Vdc is connected in parallel to a series circuit of two switching elements Q1 and Q2 which are alternately turned on, thereby forming the inverter circuit 1. Each of the switching elements Q1 and Q2 is a power MOSFET capable of switching up to, e.g., about 500 V, 3 A, and has an anti-parallel diode therein.

Connected to both ends of the switching element Q2 is a series circuit of the inductor L1 and the capacitors C1 and C2. The capacitor C1 is set to have a sufficiently large capacitance compared to the capacitor C2. For example, the capacitance of the capacitor C2 is as small as about 0.011 μF, whereas the capacitance of the capacitor C1 is set to be as large as about 0.22 μF. In this case, the capacitor C1 substantially functions as a capacitor for cutting a DC component, whereas the capacitor C2 functions as a resonant capacitor across which a voltage oscillates at a high frequency.

The inductor L1 is a current-limiting choke of about 1.7 mH. The inductor L1 and the capacitor C2 constitute an LC series resonant circuit (reactance circuit). A resonant frequency under no-load condition, i.e., a resonant frequency of the inductor L1 and the capacitor C2 without load, is $fo=1/(2\pi\sqrt{(L1\cdot C2)})\approx 37$ kHz. An operating frequency of ON/OFF of the switching elements Q1 and Q2 is set to be higher than the resonant frequency fo.

Accordingly, the current flowing through the switching elements Q1 and Q2 is in a so-called lagging mode, so that there is a period in which when one of the switching elements is turned off, the current flows through the other switching element in a backward direction. After the end of this period, the current flows through the other switching element in a forward direction.

Therefore, in this embodiment, an ON period of one switching element is a drive period in which the switching element is driven on in the forward direction. In an initial part of the ON period, current flows in the reverse direction through an anti-parallel diode connected to that switching element. In the remaining part of the ON period, current flows through the switching element in the forward direction. Further, the switching element is forcibly turned off by cutting off an ON drive signal while the current flows in the forward direction, so that a flyback current flows through an anti-parallel diode of the other switching element.

The switching elements Q1 and Q2 are respectively controlled by a square wave voltage signal (ON drive signal) supplied from the signal sources (drive circuits of the switching elements Q1 and Q2) V1 and V2. The ON drive signal of the switching element Q1 is supplied from the signal source V1 through the resistors R1 and R2. The ON drive signal of the switching element Q2 is supplied from the signal source V2 through the resistors R3 and R4. Each of the resistors R1 and R3 has a low resistance of about 10Ω, and each of the resistors R2 and R4 has a high resistance of about 10 Ω.

The signal sources V1 and V2 operate in conjunction with each other to output ON drive signals as shown in FIGS. 2A to 2D based on the dimming level. The amplitude of the ON drive signal is set to be higher than a threshold voltage between gate and source of each of the switching elements Q1 and Q2, and is, e.g., about 15 V.

Figure 2A:
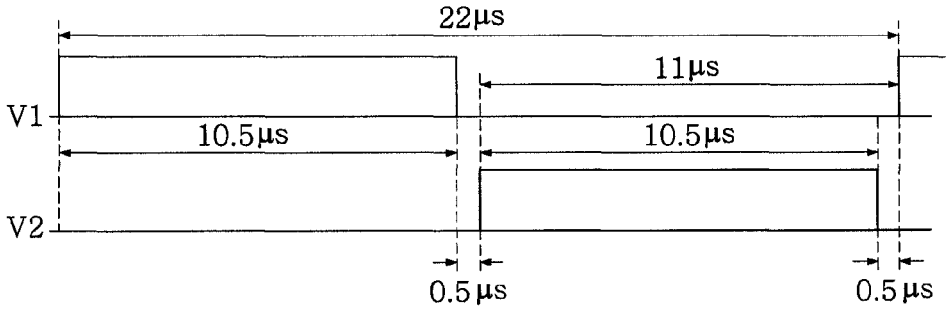
FIGS. 2A to 2D are waveform diagrams of an operation of the lighting device of the first embodiment.

FIGS. 2A to 2D are waveform diagrams of an operation of the lighting device of the first embodiment. Specifically, FIG. 2A is a waveform diagram of the ON drive signals in a full lighting state. In this example, the pulse width of both the ON drive signals from the signal sources V1 and V2 is 10.5 μs, and a dead-off time of 0.5 μs is inserted between the ON drive signals. Since one period of switching is 22 μs, a switching frequency is about 45 kHz. This is slightly higher than the resonant frequency fo ($1/(2\pi\sqrt{(L1\cdot C2)})\approx 37$ kHz) of the inductor L1 and the capacitor C2 without load. Thus, a resonant current flows in the lagging mode.

By this resonant current, a high frequency voltage alternating at the switching frequency is generated across the capacitor C2 with a small capacitance. However, in the capacitor C1 with a large capacitance, a DC voltage is charged such that the side of the inductor L1 is a positive electrode and the side of the capacitor C2 is a negative electrode. The DC voltage charged in the capacitor C1 becomes approximately half of the DC voltage from the DC input power source Vdc if the switching elements Q1 and Q2 have the same ON period.

The high frequency voltage generated across the capacitor C2 is full-wave rectified by the full-wave rectifier circuit 2 including diodes D1 to D4, so that a DC voltage is generated in a parallel circuit of the capacitor C3 and the resistor R5. A semiconductor light emitting element 3 is connected in parallel to the parallel circuit of the capacitor C3 and the resistor R5. The capacitor C3 includes two capacitors of, e.g., about 0.82 μF which are connected in parallel. The resistor R5 has a resistance value of about 100Ω. The semiconductor light emitting element 3 is a circuit including, e.g., twenty-four LEDs connected in series, and is turned on by a DC voltage of the capacitor C3. In the example of FIG. 2A, a load current flowing through the semiconductor light emitting element 3 was about 300 mA. Further, a load voltage was about 73 V.

Figure 2B:
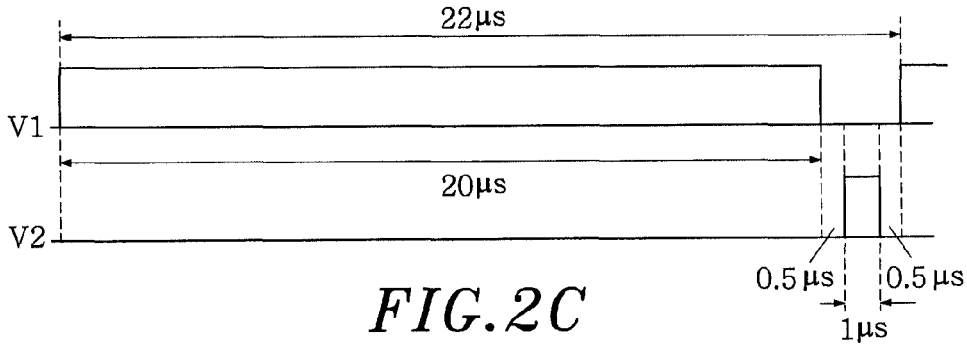

Next, in an example of FIG. 2B, the pulse width of the ON drive signal of the switching element Q1 outputted from the signal source V1 is 20 μs, whereas the pulse width of the ON drive signal of the switching element Q2 outputted from the signal source V2 is 1 μs, and a dead-off time of 0.5 μs is inserted between the ON drive signals. Since one period of switching is 22 μs, a switching frequency is about 45 kHz as in the example of FIG. 2A. However, since a ratio of the ON period of the switching element Q1 to the ON period of the switching element Q2 is 20:1 and the ON periods are uneven, the DC voltage across the capacitor C1 for cutting a DC component is higher than approximately half of the DC voltage from the DC input power source Vdc. In this case, as disclosed in Japanese Patent No. 2,975,029, the current supplied to the load connected to the capacitor C2 is reduced. In the example of FIG. 2B, the present inventors have found that the load current flowing through the semiconductor light emitting element 3 was about 40 mA.

Figure 2C:
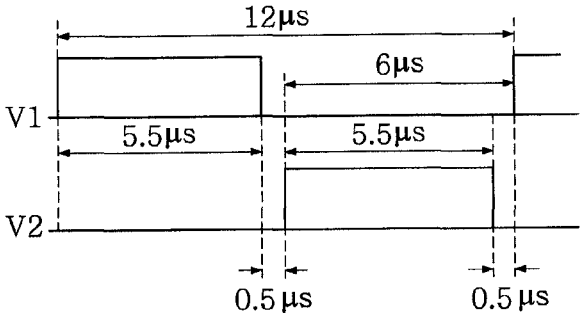

In an example of FIG. 2C, the pulse width of both the ON drive signals from the signal sources V1 and V2 is 5.5 μs, and a dead-off time of 0.5 μs is inserted between the On drive signals. Since one period of switching is 12 μs, a switching frequency is about 83 kHz. This is largely higher than the resonant frequency fo ($1/(2\pi\sqrt{(L1 \cdot C2)})\approx 37$ kHz) at which only the inductor L1 and the capacitor C2 are present without load. Thus, the voltage across the resonant capacitor C2 is reduced, and the load current flowing through the semiconductor light emitting element 3 was about 13 mA.

Figure 2D:
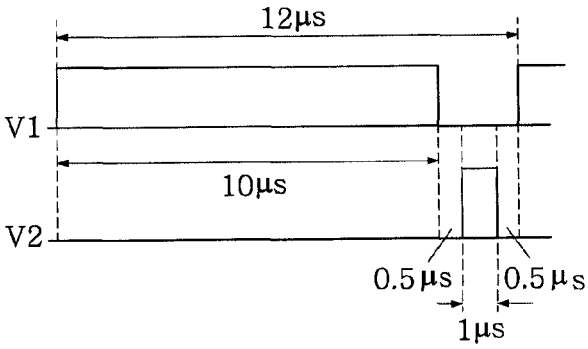

In an example of FIG. 2D, the pulse width of the ON drive signal of the switching element Q1 outputted from the signal source V1 is 10 μs, whereas the pulse width of the ON drive signal of the switching element Q2 outputted from the signal source V2 is 1 μs, and a dead-off time of 0.5 μs is inserted between the ON drive signals. Since one period of switching is 12 μs, a switching frequency is about 83 kHz as in the example of FIG. 2C. This is largely higher than the resonant frequency fo ($1/(2\pi\sqrt{(L1 \cdot C2)})\approx 37$ kHz) at which only the inductor L1 and the capacitor C2 are present without load.

Further, a ratio of the ON period of the switching element Q1 to the ON period of the switching element Q2 is 10:1, and the DC voltage across the capacitor C1 for cutting a DC component is higher than approximately half of the DC voltage from the DC input power source Vdc. In this case, since the frequency-controlled dimming as in the example of FIG. 2C and the duty ratio-controlled dimming as in the example of FIG. 2B are performed at the same time, by its synergistic effect, the load current flowing through the semiconductor light emitting element 3 is significantly reduced, and was about 1.25 mA.

As described above, in a minimum dimming state (load current: about 1.25 mA) of FIG. 2D, it is possible to realize dimming in a wide range of 240:1 compared to the full lighting state (load current: about 300 mA) of FIG. 2A. On the other hand, in the minimum dimming state (frequency: about 83 kHz) of FIG. 2D, a variation range of the switching frequency can be limited to a narrow range less than twice the frequency of the full lighting state (frequency: about 45 kHz) of FIG. 2A.

Therefore, in accordance with the embodiment of the present invention, there is an advantage that it is possible to realize dimming control in a wide range while maintaining a narrow variation range of the switching frequency.

Further, in the examples of FIGS. 2A to 2D, the dead-off time is inserted in order to eliminate a period in which the switching elements Q1 and Q2 are turned on at the same time, and is not limited to 0.5 μs. The same is true for other numbers.

FIGS. 3A to 3E show a combination of the frequency-controlled dimming and the duty ratio-controlled dimming, wherein a horizontal axis represents the switching frequency f, and a vertical axis represents the light output of the semiconductor light emitting element 3.

Figure 3A:
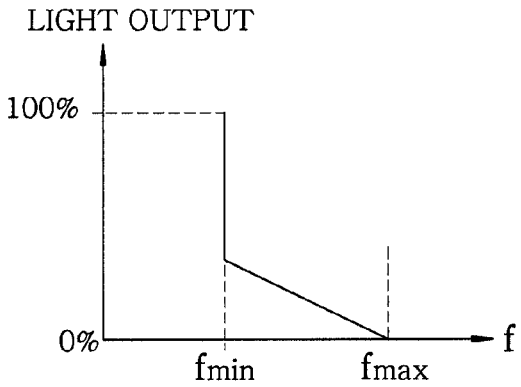
FIGS. 3A to 3E are graphs showing the operation of the lighting device of the first embodiment.

In a control example of FIG. 3A, a dimming range is divided into a high luminance region and a low luminance region. Then, the duty ratio-controlled dimming is performed in the high luminance region and the frequency-controlled dimming is performed in the low luminance region. That is, from the full lighting state (state of FIG. 2A) having a light output of 100%, while maintaining the switching frequency f at a minimum frequency fmin (e.g., about 45 kHz), the light output is reduced until the limit of dimming control using variation in the ratio of the ON periods of the switching elements Q1 and Q2 (e.g., state of FIG. 2B).

After that, by increasing the switching frequency f up to a maximum frequency fmax (e.g., about 83 kHz), the dimming is performed until the limit of dimming control using the frequency control (e.g., state of FIG. 2D). In this case, it is possible to reduce the number of times of switching in the high luminance region in which the switching current is high, so that the switching loss can be reduced while reducing the switching noise.

Figure 3B:
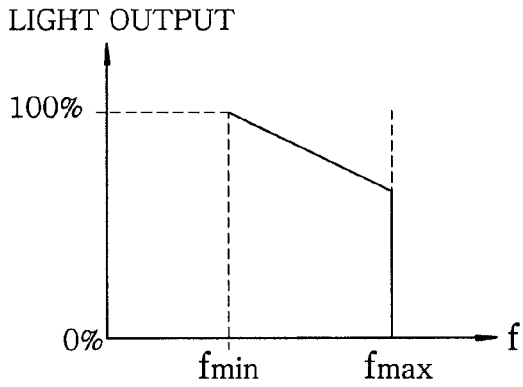

In a control example of FIG. 3B, a dimming range is divided into a high luminance region and a low luminance region. Then, the frequency-controlled dimming is performed in the high luminance region and the duty ratio-controlled dimming is performed in the low luminance region. That is, from the full lighting state (state of FIG. 2A) having an light output of 100%, by increasing the switching frequency f from the minimum frequency fmin (e.g., about 45 kHz) to the maximum frequency fmax (e.g., about 83 kHz) while maintaining the ON periods of the switching elements Q1 and Q2 to be substantially equal, the dimming is performed until the limit of dimming control using the frequency control (e.g., state of FIG. 2C).

After that, by controlling the ON periods of the switching elements Q1 and Q2 to be uneven, the light output is reduced until the limit of dimming control using the duty ratio control (e.g., state of FIG. 2D). In this case, in the high luminance region in which the switching current is high, the current is distributed evenly to each switching element. Accordingly, it is possible to prevent excessive thermal stress from being applied to only one switching element.

Figure 3C:
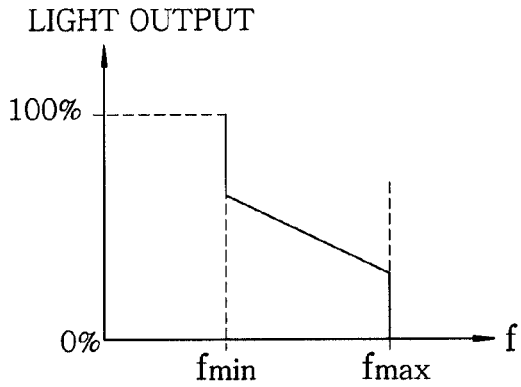

A control example of FIG. 3C is a compromise between the example of FIG. 3A and the example of FIG. 3B. In this case, a dimming range is divided into a high luminance region, a medium luminance region, and a low luminance region. Then, the duty ratio-controlled dimming is performed in the high luminance region and the low luminance region and the frequency-controlled dimming is performed in the medium luminance region.

In this case, as in the control example of FIG. 3A, since it is possible to reduce the number of times of switching in the high luminance region in which the switching current is high, there is an advantage that it is possible to reduce the switching loss while reducing the switching noise. Further, since the frequency-controlled dimming is started before the ON periods of the switching elements Q1 and Q2 become excessively uneven, it is possible to reduce the imbalance of thermal stress of each switching element.

Figure 3D:
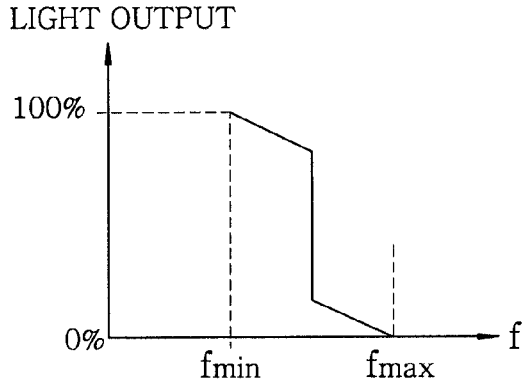

A control example of FIG. 3D is also a compromise between the example of FIG. 3A and the example of FIG. 3B. In this case, a dimming range is divided into a high luminance region, a medium luminance region, and a low luminance region. Then, the frequency-controlled dimming is performed in the high luminance region and the low luminance region and the duty ratio-controlled dimming is performed in the medium luminance region. For example, if frequency of use is low in the vicinity of a maximum output or minimum output, a filter circuit for removing switching noise may be provided to selectively remove a frequency near the middle between the minimum frequency fmin and the maximum frequency fmax, so that it becomes possible to efficiently remove the switching noise in a luminance region with a relatively high use frequency.

Figure 3E:
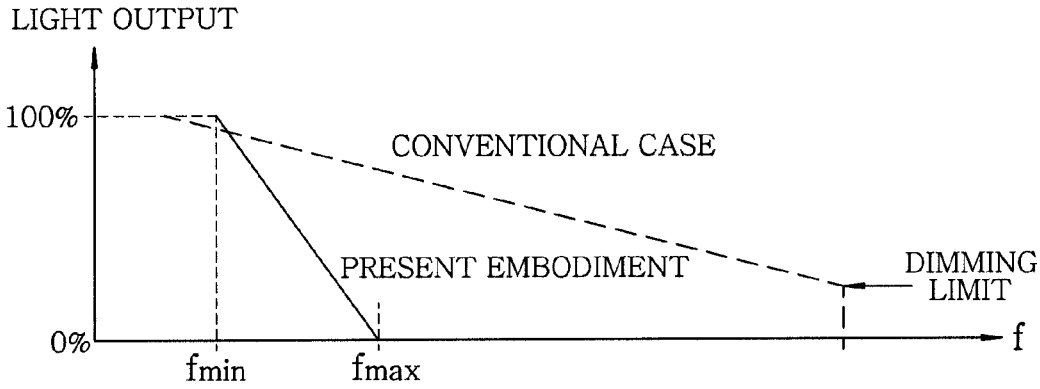

A control example of FIG. 3E is an example in which the frequency-controlled dimming and the duty ratio-controlled dimming are performed at the same time. In FIG. 3, a solid line shows control characteristics of the present embodiment using a combination of the frequency-controlled dimming and the duty ratio-controlled dimming, and a dashed line shows control characteristics of the conventional case using only the frequency-controlled dimming. As in the conventional case (JP2001-351789), in case of extensively dimming the light output only by using the frequency control, it is necessary to expand a variation range of the frequency, and it is difficult to remove the switching noise. Further, particularly, in the low luminance region, the resonant voltage is reduced due to an increase in switching frequency, and there is a problem in that it is difficult to obtain a voltage required for turning on the LED load. Further, there is a problem of an increase in switching loss.

In contrast, in the control characteristics (solid line) of the present embodiment using a combination of the frequency-controlled dimming and the duty ratio-controlled dimming, even if the variation range of the frequency is narrow, it is possible to realize dimming operation in a wide range by performing the duty ratio control in combination with the frequency control. Accordingly, it is possible to easily design the filter circuit for removing switching noise, and it is possible to avoid an increase in switching loss. Further, since it is possible to prevent the resonant voltage from being reduced due to an excessive increase in switching frequency, it is possible to realize an LED illumination apparatus capable of performing stable dimming operation even at a low light flux without causing a problem such that it is impossible to obtain a voltage required for turning on the LED load.

(Second Embodiment)

Figure 4:
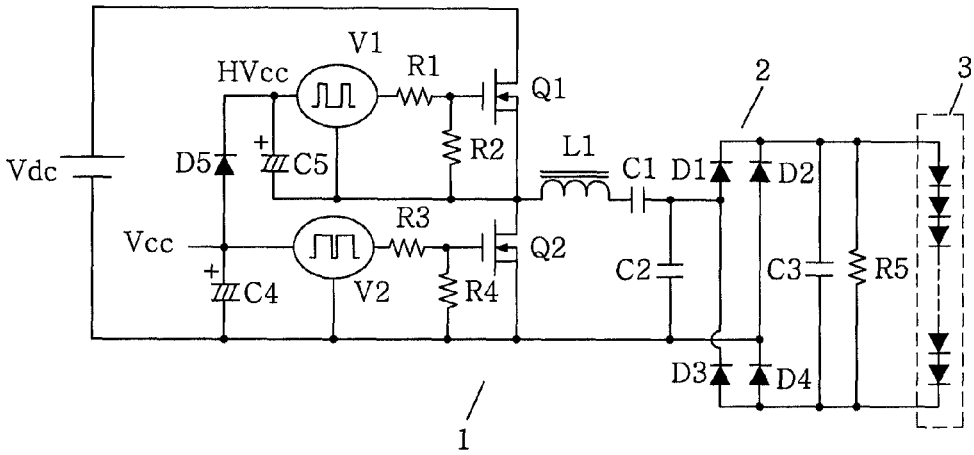
FIG. 4 is a circuit diagram of a lighting device for a semiconductor light emitting element in accordance with a second embodiment of the present invention.

FIG. 4 is a circuit diagram of a lighting device for a semiconductor light emitting element in accordance with a second embodiment of the present invention. The lighting device in this embodiment includes a DC input power source Vdc, power capacitors C4 and C5, a bootstrap diode D5, signal sources V1 and V2, resistors R1 to R5, capacitors C1 to C3, an inductor L1, an inverter circuit 1 and a rectifier circuit 2.

The signal sources V1 and V2 are respectively supplied with power from the power capacitors C5 and C4. The power capacitor C4 at the low potential side is charged from, e.g., the DC input power source Vdc through a resistor (not shown) with high resistance for step-down. The voltage across the power capacitor C4 is regulated by a constant voltage element (not shown) such as a Zener diode, so that a substantially constant control power supply voltage Vcc is charged in the power capacitor C4. The power capacitor C5 at the high potential side is charged from the power capacitor C4 at the low potential side through the so-called bootstrap diode D5 when the switching element Q2 at the low potential side is turned on.

In the first embodiment, when the ON drive signals of the switching elements Q1 and Q2 are controlled to be uneven, as shown in FIG. 2B or 2D, the pulse width of the ON drive signal outputted from the signal source V1 at the high potential side is controlled to be larger than the pulse width of the ON drive signal outputted from the signal source V2 at the low potential side. On the other hand, in the second embodiment, when the ON drive signals of the switching elements Q1 and Q2 are controlled to be uneven, the pulse width of the ON drive signal outputted from the signal source V2 at the low potential side is controlled to be larger than the pulse width of the ON drive signal outputted from the signal source V1 at the high potential side. Accordingly, since the charging time of the power capacitor C5 at the high potential side is not shorter than the discharging time thereof, the control power supply voltage HVcc at the high potential side will no longer be insufficient, even if an electrolytic capacitor with a relatively small capacitance is used as the power capacitor C5.

As known, an aluminum electrolytic capacitor used as the power capacitor easily loses its capacitance due to temperature rise or changes over time. For this reason, in the long-life LED lighting device, the electrolytic capacitor needs to be designed to have a large capacitance with a margin. In contrast, in the present embodiment, since the power capacitor C5 at the high potential side can be designed to have a small capacitance, it is possible to achieve the miniaturization of the apparatus.

(Third Embodiment)

Figure 5:
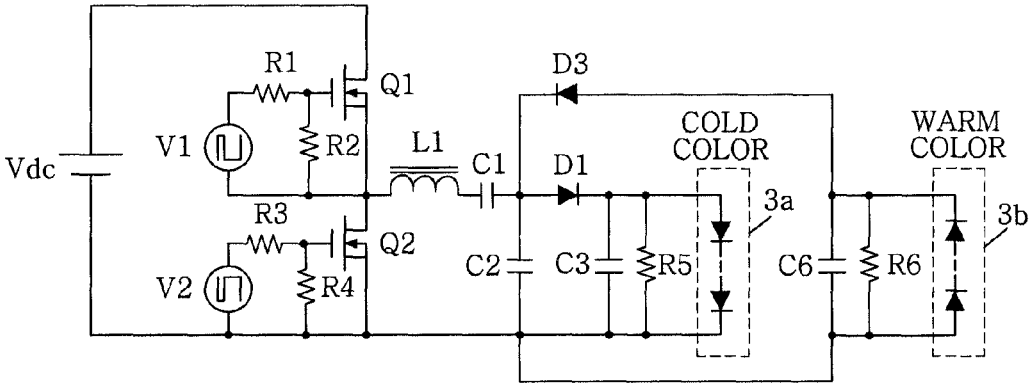
FIG. 5 is a circuit diagram of a lighting device for a semiconductor light emitting element in accordance with a third embodiment of the present invention.

FIG. 5 is a circuit diagram of a lighting device for a semiconductor light emitting element in accordance with a third embodiment of the present invention. The lighting device in this embodiment includes a DC input power source Vdc, signal sources V1 and V2, resistors R1 to R6, capacitors C1 to C3, a capacitor C6, an inductor L1, switching elements Q1 and Q2 and diodes D1 and D3.

In this embodiment, two half-wave rectifier circuits of opposite polarity, formed of the diodes D1 and D3, are connected in parallel in lieu of the full-wave rectifier circuit including the diodes D1 to D4 in the first embodiment shown in FIG. 1. Connected to the resonant capacitor C2 is a parallel circuit of a capacitor C3, a resistor R5 and a semiconductor light emitting element 3*a* through the diode D1. Further, connected to the resonant capacitor C2 is a parallel circuit of a capacitor C6, a resistor R6 and a semiconductor light emitting element 3*b* through the diode D3 of reverse polarity.

The semiconductor light emitting elements 3*a* and 3*b* may have the same color temperature, but may have different color temperatures (e.g., cold and warm colors). In the latter case, by controlling the ON periods of the switching elements Q1 and Q2 to be uneven, it is possible to vary the color temperature of mixed light. Further, the luminance of the mixed light may be adjusted by varying the switching frequency of the switching elements Q1 and Q2, by intermittently setting a low frequency pause period in a high frequency switching operation, or by using both methods in combination.

In the above-mentioned JP2001-351789, there has been proposed color mixing and dimming operation of semiconductor light emitting elements connected to the output of the half-bridge inverter circuit through the LC series resonant circuit (claim 6 in JP2001-351789). However, in the technique of JP2001-351789, it is necessary to provide separate LC series resonant circuits having different resonant frequencies for the respective semiconductor light emitting elements having different color temperatures, which makes the circuit configuration complicated. Further, in order to vary the color temperature of the mixed light, it is necessary to change the switching between the different resonant frequencies, and the current flowing through one of the resonant circuits is in a leading mode (claim 3 in JP2001-351789).

On the other hand, in accordance with the configuration of the present embodiment, since the current flowing through the resonant circuit can be in the lagging mode all the time, it is possible to prevent two switching elements connected in series from being turned on at the same time, and to reduce switching loss. Further, since it can be configured by using only one LC series resonant circuit, there is an advantage of simple circuit configuration.

Further, in accordance with the configuration of the present embodiment, it is possible to control the color temperature of the mixed light by changing the ratio of the ON periods of two switching elements, and also it is possible to control the luminance of the mixed light by changing the switching frequency. Accordingly, compared to the control of varying the color temperature of the mixed light by changing the switching frequency as in the technique of JP2001-351789, it is no longer required to set a pause period of the switching operation for dimming control (see Paragraph [0099] and FIG. 15 in JP2001-351789). Thus, compared to the technique of JP2001-351789, it is possible to reduce the flicker.

In addition, although not shown, as in JP2001-351789, the series circuit of the LED load may be connected in reverse parallel to both ends of the resonant capacitor C2. In such case, the diode characteristics of the LED also serve the function of the rectifier circuit 2.

(Fourth Embodiment)

Figure 6:
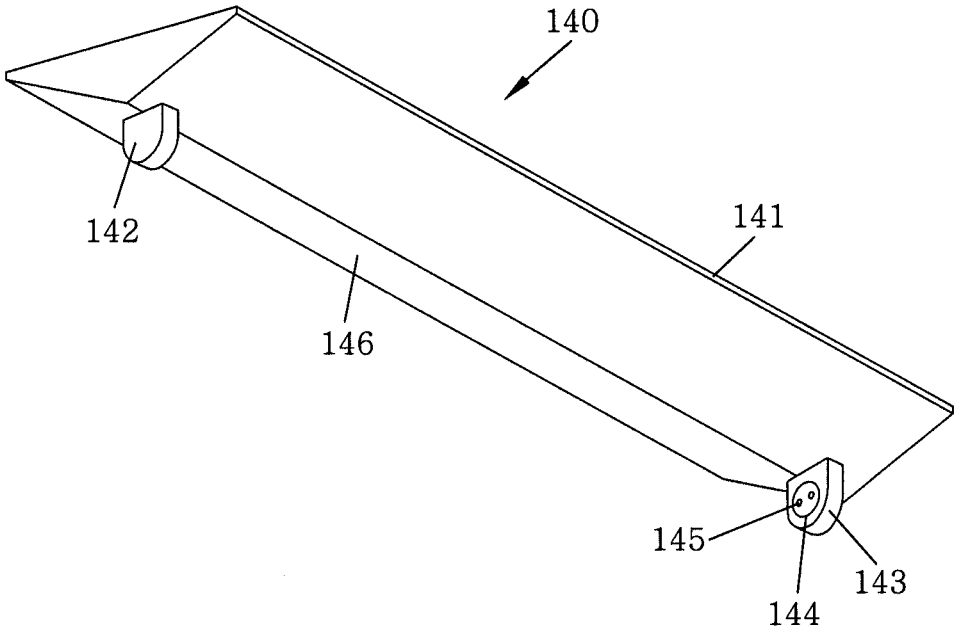
FIG. 6 illustrates a configuration of an illumination apparatus in accordance with a fourth embodiment of the present invention.

The lighting device of each of the first to the third embodiments may be used in, e.g., a straight pipe type LED illumination apparatus 140 shown in FIG. 6. FIG. 6 illustrates the straight pipe type LED illumination apparatus 140 in accordance with the fourth embodiment of the present invention. The straight pipe type LED illumination apparatus 140 shown in FIG. 6 is an illumination apparatus having one lamp.

As illustrated in FIG. 6, the LED illumination apparatus 140 includes an apparatus main body 141 in which the lighting device is installed, a pair of sockets 142 and 143 having lamp pin contact holes 145 through which the straight pipe type LED is attached to both ends of the apparatus main body 141 and a spring 144, and a reflection plate 146.

When the lighting device of each of the first to the third embodiments is applied to the illumination apparatus 140 shown in FIG. 6, the same effect as that of the above embodiment can be obtained.

Further, the lighting device of each of the first to the third embodiments may be applied to an apparatus having two or more lamps.

Further, various shapes of LEDs may be used instead of straight pipe type LEDs used in a shop or a facility.

In the above embodiments, the light emitting diode has been illustrated as the semiconductor light emitting element, but it is not limited thereto. For example, an organic electroluminescent (EL) element, semiconductor laser element or the like may be used.

While the invention has been shown and described with respect to the embodiments, it will be understood by those skilled in the art that various changes and modification may be made without departing from the scope of the invention as defined in the following claims.

What is claimed is:

1. A lighting device for one or more semiconductor light emitting elements, comprising:

a series circuit of two switching elements which are alternately turned on using different square wave voltage signals, respectively, the series circuit being connected in parallel to a direct current (DC) input power source; and a reactance circuit connected between a connection node of the two switching elements and one end of the DC input power source through a capacitor, an output of the reactance circuit being supplied to the semiconductor light emitting elements through a rectifier circuit, wherein a dimming operation of the semiconductor light emitting elements is performed by varying a ratio of ON periods of the two switching elements, wherein the ON periods of the two switching elements are determined by the square wave voltage signals, respectively, wherein the number of the semiconductor light emitting elements is 2, and the rectifier circuit includes two half-wave rectifier circuits of reverse polarity, which are respectively connected to the semiconductor light emitting elements having different color temperatures, and wherein a color temperature of mixed light is changed by controlling the ratio of the ON periods of the two switching elements, and luminance of the mixed light is changed by controlling a switching frequency of the two switching elements.

2. The lighting device of claim 1, wherein the reactance circuit includes a series connection of a current-limiting choke and an additional capacitor, and the rectifier circuit is connected to the additional capacitor.

3. The lighting device of claim 2, wherein each of the switching elements is connected in parallel to an anti-parallel diode, and a switching frequency of the switching elements is set higher than a series resonant frequency of the current-limiting choke and the additional capacitor.

4. The lighting device of claim 2, further comprising a capacitor which is connected in parallel to one of the semiconductor light emitting elements provided on an output side of the rectifier circuit.

5. The lighting device of claim 1, wherein the ON period of one of the switching elements at a low potential side of the DC input power source is controlled longer than the ON period of the other one of the switching elements at a high potential side of the DC input power source, and further comprising a bootstrap diode through which a charging current flows to a power capacitor of a drive circuit of said the other one of the switching elements from a power capacitor of a drive circuit of said one of the switching elements when said one of the switching elements is turned on.

6. An illumination apparatus comprising the lighting device for the semiconductor light emitting elements described in claim 1.

7. A lighting device for one or more semiconductor light emitting elements, comprising:

a series circuit of two switching elements which are alternately turned on using different square wave voltage signals, respectively, the series circuit being connected to a direct current (DC) input power source; and a reactance circuit connected between a connection node of the switching elements and one end of the DC input power source through a capacitor, an output of the reactance circuit being supplied to the semiconductor light emitting elements through a rectifier circuit, wherein a dimming operation of the semiconductor light emitting elements is performed by varying a switching frequency and a ratio of ON periods of the two switching elements, wherein the ON periods of the two switching elements are determined by the square wave voltage signals, respectively, wherein the number of the semiconductor light emitting elements is 2, and the rectifier circuit includes two half-wave rectifier circuits of reverse polarity, which are respectively connected to the semiconductor light emitting elements having different color temperatures, and wherein a color temperature of mixed light is changed by controlling the ratio of the ON periods of the two switching elements, and luminance of the mixed light is changed by controlling the switching frequency of the two switching elements.

8. The lighting device of claim 7, wherein the reactance circuit includes a series connection of a current-limiting choke and an additional capacitor, and the rectifier circuit is connected to the additional capacitor.

9. The lighting device of claim 8, wherein each of the switching elements is connected in parallel to an anti-parallel diode, and the switching frequency of the switching elements is set higher than a series resonant frequency of the current-limiting choke and the additional capacitor.

10. The lighting device of claim 8, further comprising a capacitor which is connected in parallel to one of the semiconductor light emitting elements provided on an output side of the rectifier circuit.

11. The lighting device of claim 7, wherein the ON period of one of the switching elements at a low potential side of the DC input power source is controlled longer than the ON period of the other one of the switching elements at a high potential side of the DC input power source, and further comprising a bootstrap diode through which a charging current flows to a power capacitor of a drive circuit of said the other one of the switching elements from a power capacitor of a drive circuit of said one of the switching elements when said one of the switching elements is turned on.

12. An illumination apparatus comprising the lighting device for the semiconductor light emitting elements described in claim 7.

13. The lighting device of claim 7, wherein a dimming range of the semiconductor light emitting elements is divided into at least two dimming regions, and in each of the regions, dimming is carried out by varying only one of the switching frequency and the ratio of ON periods of the two switching elements.

14. The lighting device of claim 13, wherein one of the switching frequency and the ratio of ON periods of the two switching elements is varied in one of two neighboring dimming regions and the other of the switching frequency and the ratio of ON periods of the two switching elements is varied in the other of the two neighboring dimming regions.

* * * * *